US006681784B2

(12) United States Patent
Chou et al.

(10) Patent No.: US 6,681,784 B2
(45) Date of Patent: Jan. 27, 2004

(54) UMBRELLA FACET CONNECTING MECHANISM

(75) Inventors: Fu-Yi Chou, Sanchung (TW); Chiu-Chan Yen, Sanchung (TW)

(73) Assignee: Fortune Umbrella Co., Ltd., Taipei Hsien (TW)

( * ) Notice: Subject to any disclaimer, the term of this patent is extended or adjusted under 35 U.S.C. 154(b) by 50 days.

(21) Appl. No.: 10/082,078

(22) Filed: Feb. 26, 2002

(65) Prior Publication Data

US 2003/0159725 A1 Aug. 28, 2003

(51) Int. Cl.[7] ..... A45B 25/22
(52) U.S. Cl. ..... 135/33.7; 135/33.4; 135/31
(58) Field of Search ..... 135/33.7, 33.4, 135/33.41, 33.2, 25.31, 32, 31; 24/711.3, 709.4, 710.9, 549

(56) References Cited

U.S. PATENT DOCUMENTS 5,078,166 A * 1/1992 Lee ..... 135/33.7
6,024,109 A * 2/2000 Lin et al. ..... 135/33.7
6,089,244 A * 7/2000 Ko ..... 135/33.7
6,095,171 A * 8/2000 Lin et al. ..... 135/33.7
6,173,724 B1 * 1/2001 You ..... 135/33.7
6,336,464 B1 * 1/2002 Ko ..... 135/29
6,474,352 B1 * 11/2002 Lee ..... 135/31
6,502,592 B2 * 1/2003 Chen ..... 135/33.7

FOREIGN PATENT DOCUMENTS

FR 2664137 * 10/1992

* cited by examiner

*Primary Examiner*—Winnie S. Yip
(74) *Attorney, Agent, or Firm*—Rosenberg, Klein & Lee

(57) ABSTRACT

An umbrella facet connecting mechanism which mainly comprises the umbrella facet connection, there is a bending position on said umbrella facet connection, and there settles a connecting portion on two ends portion and the bending portion respectively; the connecting portion on one end of the umbrella facet connection is fixed and connected with the second umbrella facet, whereas another end portion and the connecting portion on bending being fixed and connected with the first umbrella facet so that the peripheral of the first umbrella facet overlaps and connects with that of the second umbrella facet and there keeps a space so when the umbrella facet is on the accepting wind facet said stream could be vent from the space between the overlap position of the first and the second umbrella facet to avoid the flip-out of the major bone of the umbrella to achieve the purpose of anti-winds as well as elonger the usage lifetime of the umbrella.

1 Claim, 6 Drawing Sheets

UMBRELLA FACET CONNECTING MECHANISM

BACKGROUND OF THE INVENTION

1. Field of the Invention

This invention relates to an umbrella facet connecting mechanism, especially refers to an umbrella facet connecting mechanism which overlaps and connects the first umbrella facet and the second umbrella facet through an umbrella facet connecting means to keep a space for vent of stream flow.

2. Description of the Prior Art

For the life of the general people, the umbrella is one relative important house goods, for example on sunny days, rainy days there is necessary for bringing the umbrella at hand to avoid the trouble of sunlight or raining as well as ensure the health. So even there is history for the development of the umbrella, it is always undisappeared and adopted by people.

Traditional umbrella facet of the umbrella is an arc facet to benefit the rain sliding to the ground along the arc umbrella facet; however, although such umbrella facet is beneficial to the dropping of the rain, if the strong winds are invasive, since said strong winds dropping directly on the outside umbrella facet of the umbrella means, it causes the increase of the supporting force of the umbrella by the user, and the major bone of the umbrella also bends on strong winds; besides, once the inner umbrella facet is on the face-wind facet, it must cause the major bone of the umbrella damage due to wind blowing, which requires to be bettered in practice.

From his we know, there still are many drawbacks for the above-mentioned traditional object, which is not a fine design and requires to be bettered.

The inventor of this invention thinked to better it and innovate it and studied for many years due to each drawback derivated by the above-mentioned traditional umbrella means and finally successfully complete the research the umbrella facet connecting mechanism of this invention.

SUMMARY OF THE INVENTION

The purpose of this invention is to provide an umbrella facet connecting mechanism of which the umbrella facet is settled into the upper and lower layer by means of an umbrella connecting means to keep a space for gas vent to avoid the flip out of the umbrella bone and thus avoid damage the umbrella facet of the umbrella.

Another purpose of this invention is to provide an umbrella facet connecting mechanism which could elonger the usage life of the umbrella means.

Another purpose of this invention is to provide an umbrella facet connecting mechanism of which it has many advantages such as simple structure, low cost as well as easy to manufacture.

The umbrella facet connecting mechanism which could achieve the above-mentioned purpose of the invention comprises a first umbrella facet, a second umbrella facet and the umbrella facet connecting means; wherein said umbrella facet connecting means is an elastic body and there is a bending portion on it, and there settles a connecting portion on two ends of it and on the bending region; one end of the first umbrella facet is connected with the lower portion; another end of the first umbrella facet is fixed and connected with the connecting portion on one end of the umbrella connecting means; one end of the second umbrella facet is fixed and connected with the end portion of the major bone of the umbrella; whereas another end is fixed and connected with the connecting portion on another end of the umbrella facet connecting means; whereas the connecting portion on the bending portion of said umbrella facet connecting means could be fixed and connected with the first umbrella facet or the second umbrella facet on requirement so that the peripheral portion of the first umbrella facet overlaps with the second umbrella facet and there keeps a space between so when the inner umbrella facet of the umbrella facet and that of the second umbrella facet is on the accept-wind facet, said wind force could be vent from the slit of the first umbrella facet and the second umbrella facet so that the umbrella bone will not be turn-over due to the influence of the wind force to achieve the effect of anti-winds.

BRIEF DESCRIPTION OF THE DRAWINGS

The drawings disclose an illustrative embodiment of the present invention which serves to exemplify the various advantages and objects hereof, and are as follows.

REPRESENTATIVE SYMBOLS OF MAJOR PARTS

Figure 1:
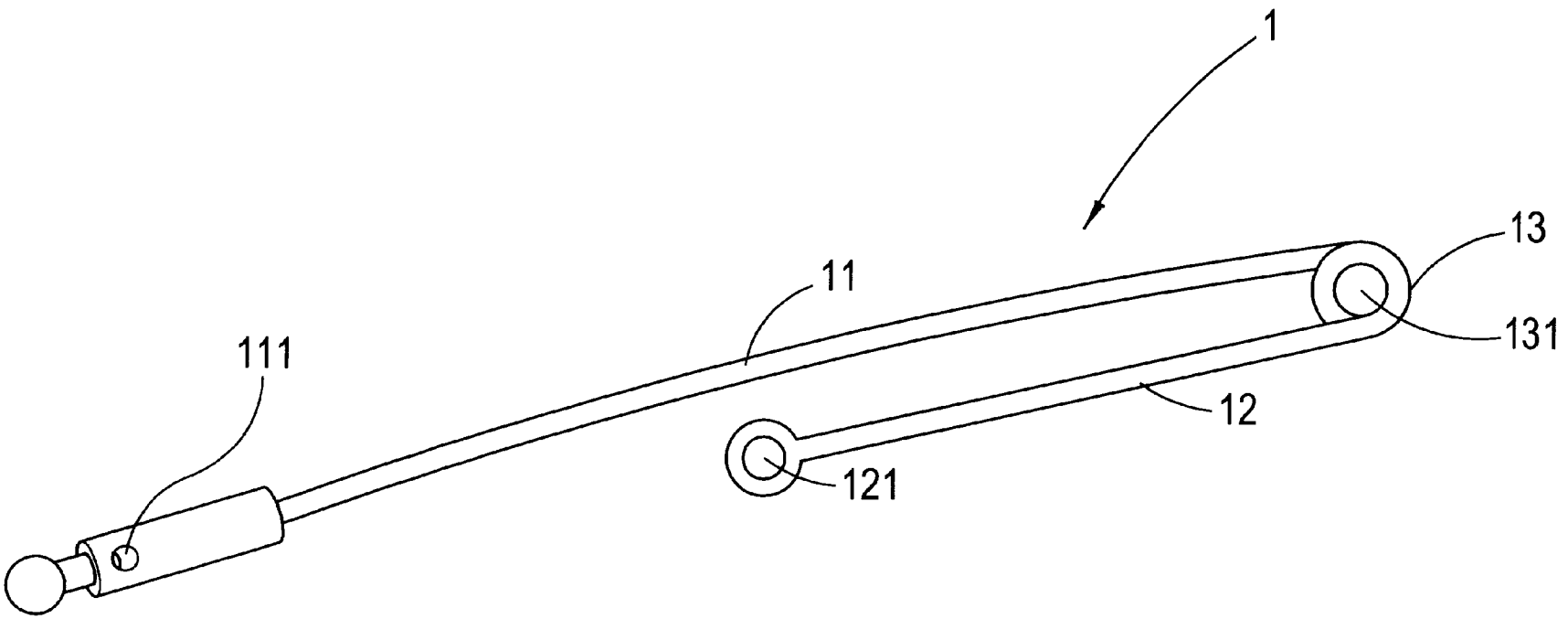
FIG. 1 is the solid illustrative figure of the umbrella facet connecting means of the umbrella facet connecting mechanism of this invention.

1. Umbrella facet connecting means
11. Upper rod body
111. Connecting portion
112 Lower rod body
121. Connecting portion
13. Bending portion
131. Connecting portion
2. First umbrella facet
21. Peripheral
22. Peripheral
3. Second umbrella facet
31. Peripheral
32. Peripheral
4. Major bone of the umbrella
5. Slit
6. Wind force
7. Straight umbrella bone
8. Upper portion

DETAILED DESCRIPTION OF THE PREFERRED EMBODIMENT

Please refer to FIG. 1, which is the illustrative figure of the umbrella facet connecting means of the umbrella facet connecting mechanism provided by this invention, said umbrella facet connecting means 1 is an elastic body on which there is a bending portion 13 so that the umbrella facet connecting means 1 forms the upper rod body 11 and the lower rod body 12, the length of said upper rod body 11 is larger than that of the lower rod body 12, and there settles a connecting portion 111, 121, 131 on the upper rod body 11, the lower rod body 12 and the bending portion 13, said connecting portion 111, 121, 131 could be a hole or other structure with the connecting functions.

Figure 2:
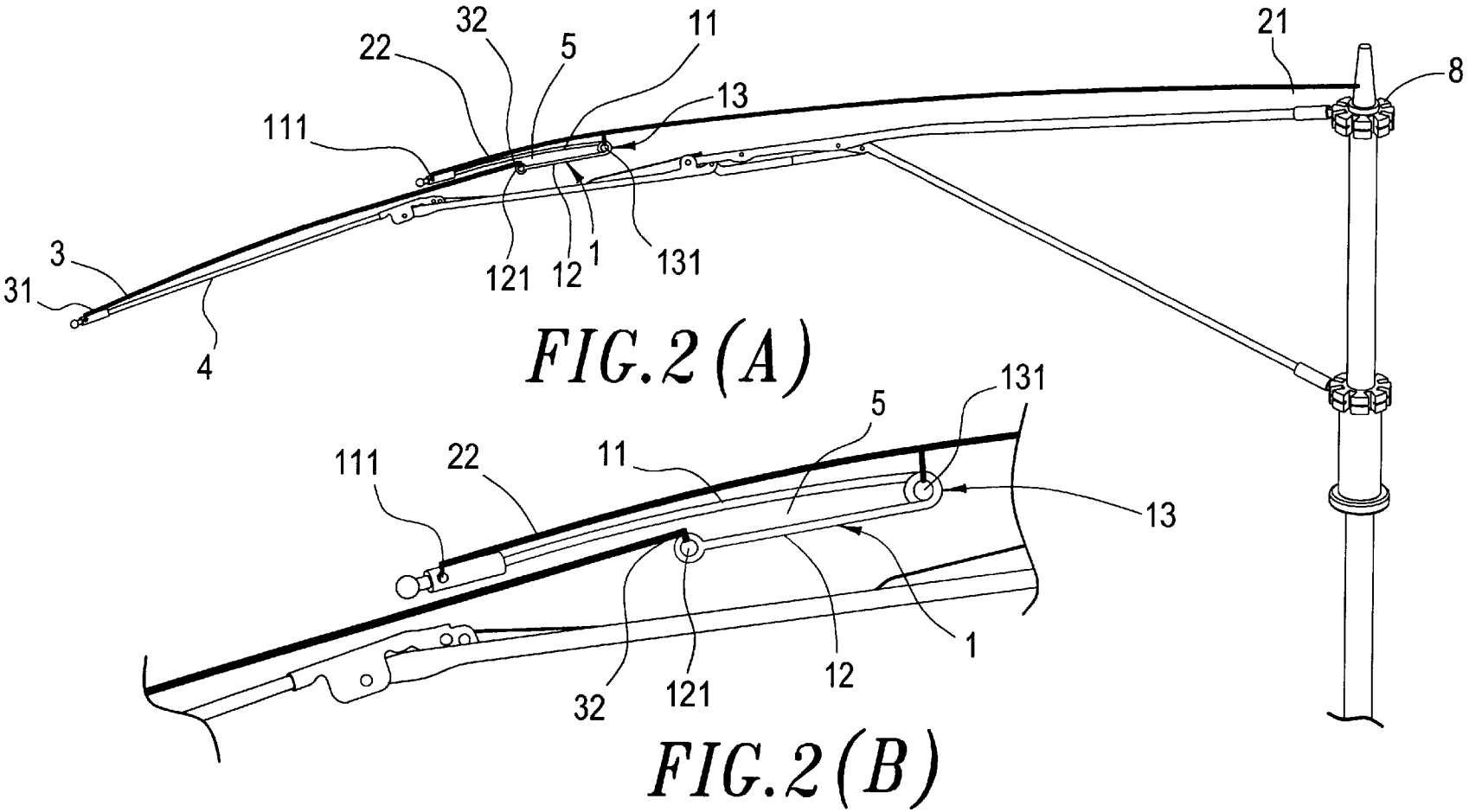
FIGS. 2(A) and (B) are the local illustrative figure of the umbrella facet connecting means of the umbrella facet connecting mechanism of this invention.
Figure 3:
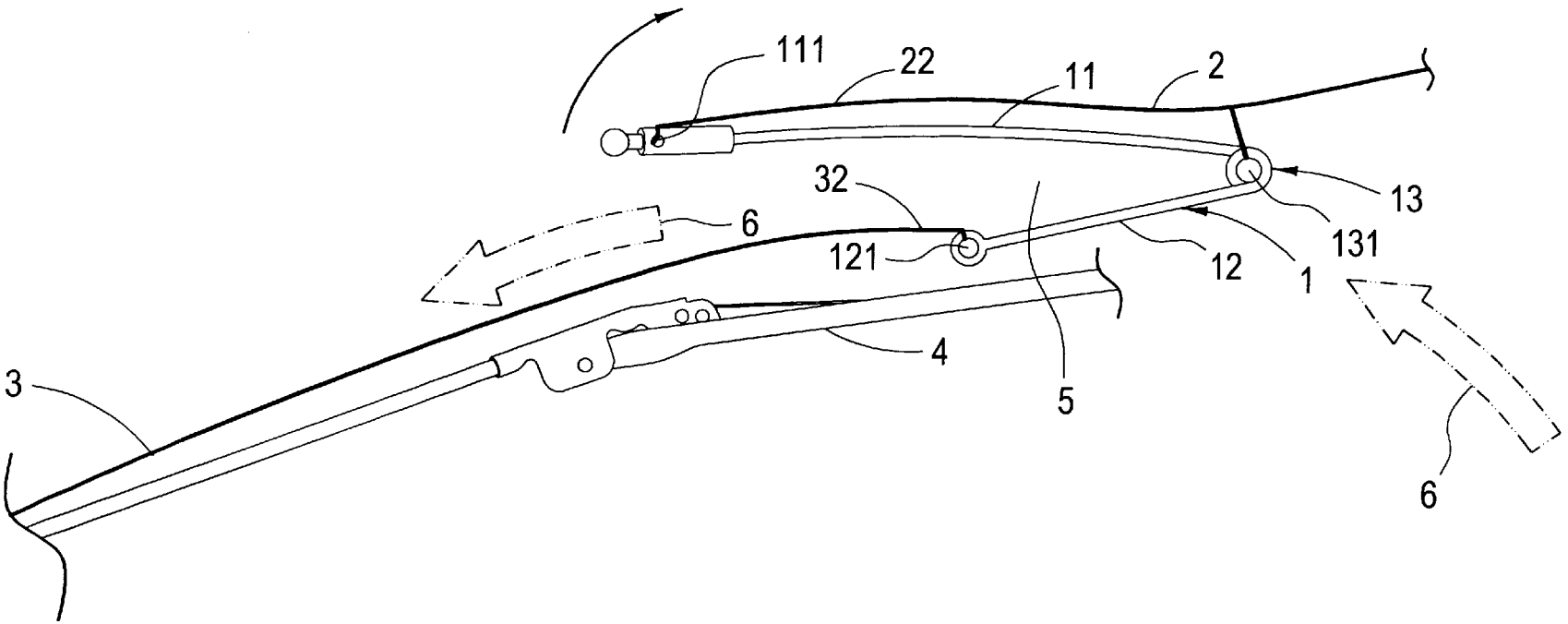
FIG. 3 is the motion illustrative figure of the umbrella facet connecting means of the umbrella facet connecting mechanism of this invention.

Please refer to FIGS. 2(A), 2(B) and FIG. (3), which is the umbrella facet connecting means provided by this invention comprising mainly:

A first umbrella facet 2, one peripheral 21 of said first umbrella facet 2 is fixed and connected with the upper portion 8, the peripheral 22 of another end is fixed and connected with the slit settled method with the upper rod portion connecting portion 111 of the umbrella facet connecting means 1, and the connecting portion 131 of the bending portion 13 of the umbrella facet connecting means 1 is fixed and connected on the suitable position of the inner facet of the upper umbrella facet 2 with the slit settled method so that the first umbrella facet 2 is pulled and supported and is spread extending on the major bone of the umbrella 4 smoothly; besides, the connecting portion 131 of the bending portion 13 of said umbrella facet connecting means 1 could also be connected with the second umbrella facet 3 with the slit settled method without influence the original function;

A second umbrella facet 3, the peripheral of one end of said second umbrella facet 3 is fixed and connected with the end portion of the major bone of the umbrella 4, the peripheral 32 on another end is fixed and connected with the connecting portion 121 of the lower rod body 12 of the umbrella facet connecting means 1 with the slit settled method so that the second umbrella facet is pulled and supported and extends on the major bone of the umbrella 4 smoothly;

Said first umbrella facet 2 and second umbrella facet 3 let the peripheral 22 of the first umbrella facet 2 overlaps with the peripheral 32 of the second umbrella facet 3 by means of the influence of the length variation of the upper rod body 11 and the lower rod body 12 of the umbrella facet connecting means 1 and forms two layers of the upper layer and the lower layer and there forms a slit 5 on its overlapping position; when the inner umbrella facet of the first umbrella facet 2 and that of the second umbrella facet 3 are on the accept-wind facet, it will cause the upper rod body 11 and the lower rod body 12 of the umbrella facet connecting means to move toward various directions by the influence of the wind force to produce a spring force and bursts the slit 5 on the overlapping position of the peripheral of the first umbrella facet and the second umbrella facet to benefit the vent of the wind force 6 so that there is no afraid of flip-out of the major bone of the umbrella 4 to achieve the purpose of anti-wind force; when the inner umbrella facet of the first umbrella facet 2 and the second umbrella facet 3, the upper rod body 11 and the lower rod body 12 of said umbrella facet connecting means 1 will restore to the original portion by the produced elasticity.

Besides, if the outer umbrella facet of the first umbrella facet 2 and the second umbrella 3 is on the accept-wind facet, said wind force 6 will be vent from the slit 5 on the overlap position of the first umbrella facet 2 and the second umbrella facet 3 to reduce the wind force accepted by the umbrella facet which could not only reduce the supporting force on bringing the umbrella of the user but also avoids the damage caused by bending of the major bone of the umbrella 4 on wind rising to longer the usage lifetime of the umbrella means.

Figure 4:
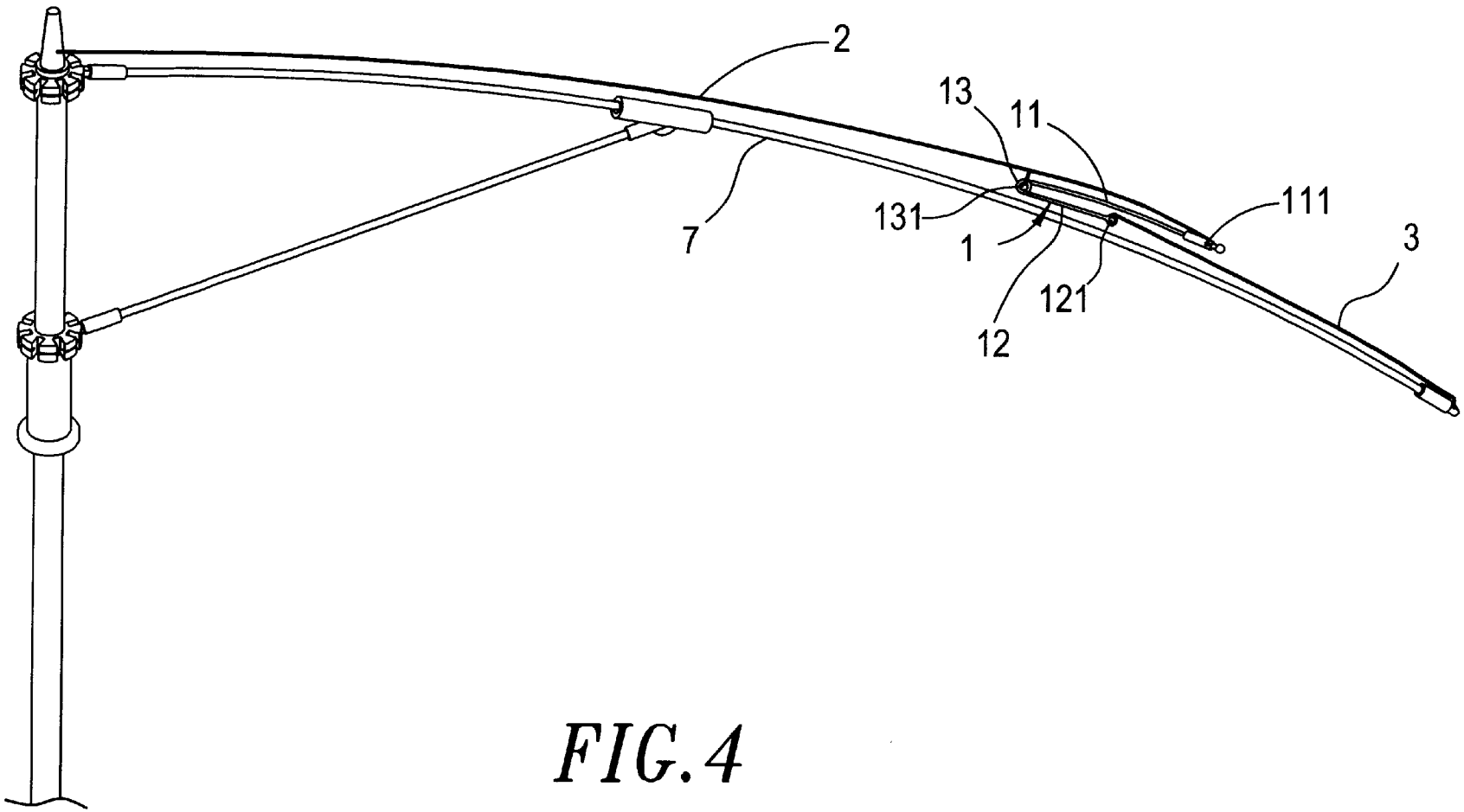
FIG. 4 is another practical local illustrative figure of the umbrella facet connecting means of the umbrella facet connecting mechanism of this invention.

Next, please refer to FIG. 4, as shown on the figure, which is another practice illustrative figure of the umbrella facet connecting mechanism provided by this invention, the application range of said umbrella connecting means 1 is very broad, which not only could be applied to the umbrella means of the foldable umbrella, if it is applied on the umbrella means of the straight umbrella bone 7, there also is the above-mentioned function as well.

Figure 5A:
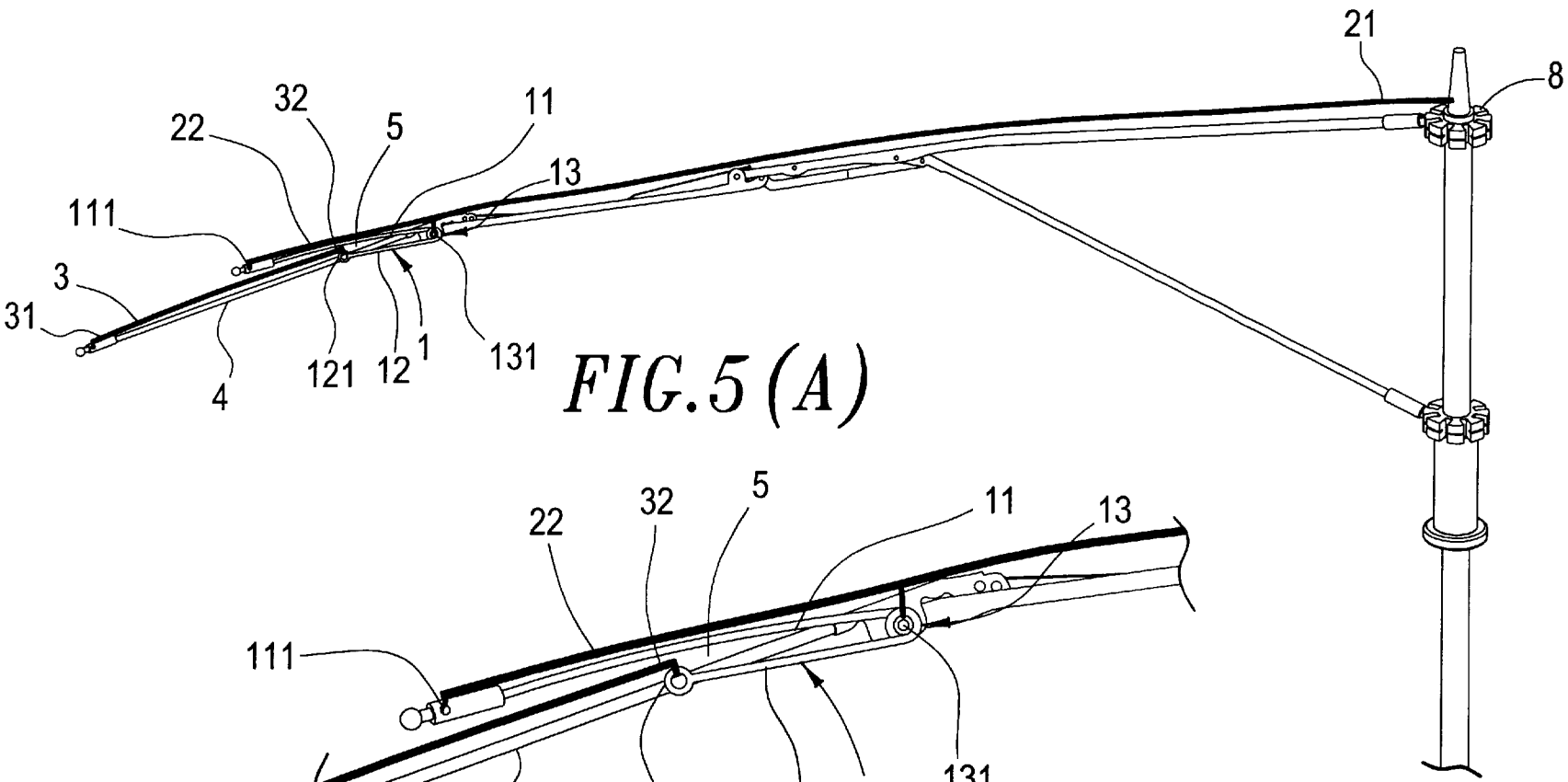
FIGS. 5(A), 5(B) are the other layout illustrative figures of the umbrella facet connecting mechanism of this invention.
Figure 5B:
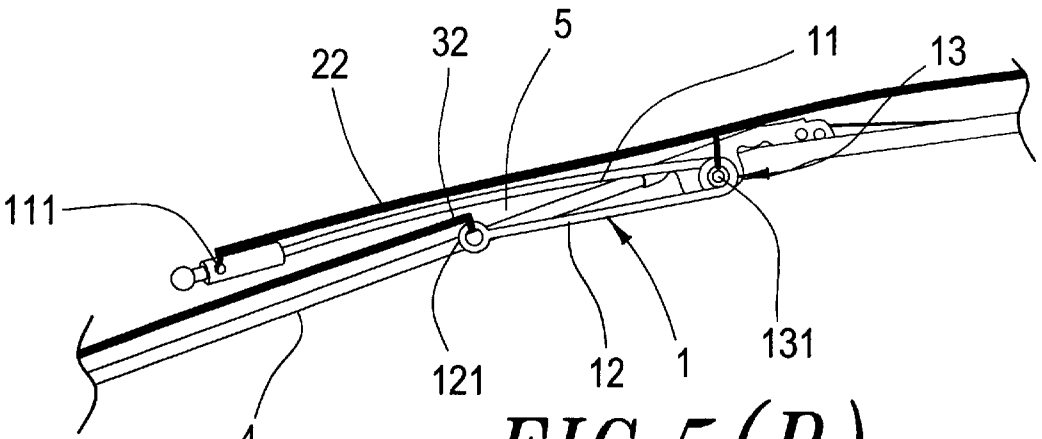
Figure 6:
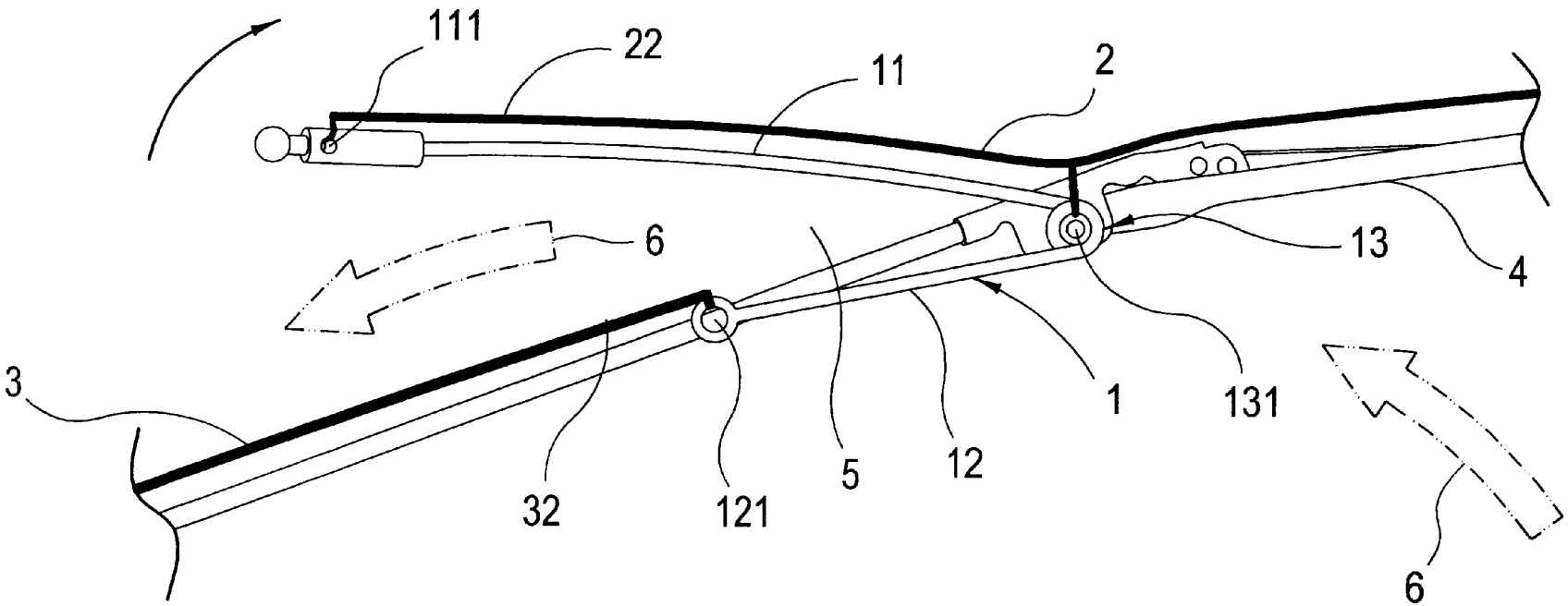
FIG. 6 is the motion illustrative figure of FIG. 5(A) and FIG. 5(B).

Besides, please refer to the figures as shown in FIG. 5(A), FIG. 5(B), and FIG (6), this invention could also settle the umbrella facet connecting means 1 on one lateral of the major bone of the umbrella 4 so that the connecting portion 131 of the bending portion 13 of the umbrella facet connecting means is in correspondence with that of the major bone of the umbrella 4; such settlement will achieve the effect of anti-winds without influencing the function of the umbrella facet connecting means 1. The above-mentioned settle way is just one embodiment way of this invention, the umbrella facet connecting means 1 of this invention could be bounded above the major bone of the umbrella or two lateral portions if necessary which is not limited upon this point.

The umbrella facet connecting mechanism provided by this invention has the following advantages in comparison with other traditional technologies:

1. This invention connects two umbrella facets by means of the umbrella facet connecting means so that two umbrella facet could be spread on the major bone of the umbrella smoothly to form the relationship of the upper and the lower layer; besides, its edge overlaps with each other, there forms a slit on the overlap position for vent of the winds so that the major bone of the umbrella will never flip-out to achieve the purpose of anti-winding.

2. The umbrella facet connecting means of this invention has the elasticity; when the inner umbrella facet of the first and second umbrella facet is on the accept wind facet, said umbrella facet connecting means will extend an angle so that on the overlap position of the first and the second umbrella facet the slit will extend relatively to rapidly vent the winds; besides, the umbrella connecting means will restore to the original position through the elastic force itself.

3. This invention has the effect of longering the usage lifetime of the umbrella means except many advantages for providing the simple structure, low-cost and easily-to-manufacture.

Many changes and modifications in the above described embodiment of this invention can, of course, be carried out without departing from the scope thereof. Accordingly, to promote the progress in science and the useful arts, the invention is disclosed and is intended to be limited only by the scope of the appended claims.

What is claimed is:

1. An umbrella comprising a frame formed by a plurality of radially directed bones displaceably coupled to a shaft and a pair of facets having overlapped portions, a first of said facets extending radially from said shaft to the overlapped portion and a second of said facets extending from the overlapped portion thereof to a distal end of said bones, the overlapped portions of said first and second facets being joined together at each bone by a respective facet connecting mechanism, said facet connecting mechanism comprising a facet connector being formed by an elastic body having a pair of spaced parallel rod bodies respectively extending from a bending portion of said elastic body, an upper one of said rod bodies being of greater length than a lower one of the rod bodies, said upper rod body having a distal end coupled to an outer peripheral edge of said first facet, said bending portion of said facet connector being coupled to said first facet, said lower rod body having a distal end coupled to an inner peripheral edge of said overlapped portion of said second facet, wherein said first and second facets are pulled and supported by said bones when said umbrella is opened and each said facet connector provides a bias force to maintain said overlapped portions of said first and second facets in contiguous relationship, said overlapped portion of said first facet being displaceable relative to said second facet responsive to a wind force being greater than said bias force to thereby form an air vent between said first and second facets.

* * * * *